US006840845B2

(12) United States Patent
Numoto

(10) Patent No.: US 6,840,845 B2
(45) Date of Patent: Jan. 11, 2005

(54) WAFER POLISHING APPARATUS

(75) Inventor: Minoru Numoto, Tokyo (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 21 days.

(21) Appl. No.: 10/295,887

(22) Filed: Nov. 18, 2002

(65) Prior Publication Data

US 2003/0096564 A1 May 22, 2003

(30) Foreign Application Priority Data

Nov. 19, 2001 (JP) ..... 2001-352927

(51) Int. Cl.[7] ..... B24B 5/00

(52) U.S. Cl. ..... 451/285; 451/398; 451/288; 451/388

(58) Field of Search ..... 451/285–289, 451/397, 398, 388

(56) References Cited

U.S. PATENT DOCUMENTS 5,584,751 A * 12/1996 Kobayashi et al. ..... 451/288
5,762,539 A * 6/1998 Nakashiba et al. ..... 451/388
5,795,215 A * 8/1998 Guthrie et al. ..... 451/286
6,113,480 A * 9/2000 Hu et al. ..... 451/289
6,196,905 B1 * 3/2001 Inaba ..... 451/288
6,273,804 B1 * 8/2001 Numoto ..... 451/288
6,290,577 B1 * 9/2001 Shendon et al. ..... 451/285
6,494,774 B1 * 12/2002 Zuniga et al. ..... 451/398
6,585,850 B1 * 7/2003 Kenji et al. ..... 451/286
6,663,466 B2 * 12/2003 Chen et al. ..... 451/287

* cited by examiner

*Primary Examiner*—Hadi Shakeri
(74) *Attorney, Agent, or Firm*—Nixon Peabody LLP; David S. Safran

(57) ABSTRACT

The wafer polishing apparatus enables the control of proper polishing pressure, so that the quality of wafers can be maintained high. A wafer holding head is composed of a carrier for pressing the wafer against a polishing pad, a retainer ring at the circumference of the carrier, and a holding head body. The holding head body includes a carrier pressing device having an air bag of which pressing surface area is 50% or smaller of the area of the wafer, and the pressing force from the carrier pressing device is transmitted to the carrier.

2 Claims, 5 Drawing Sheets

WAFER POLISHING APPARATUS

BACKGROUND OF THE INVENTION

1. Field of the Invention

The present invention relates to a wafer polishing apparatus for polishing wafers or the like using chemical mechanical polishing (CMP).

2. Description of the Related Art

The polishing of a wafer using the CMP is performed by pressing the wafer against a rotating polishing pad at a predetermined pressure while rotating the wafer, and supplying a mechanochemical abrasive between the polishing pad and the wafer. At this time, the circumference of the wafer is surrounded by a retainer ring, and the backside thereof is held by a carrier and pressed against the polishing pad.

If a mechanism is used that mechanically provides pressure to a back plate placed on the back of the wafer W to press the wafer W, the mechanism tends to apply pressure to only a certain part of the back plate. The use of an air cylinder as the mechanism is a typical example. When pressure is applied to a certain part of the back plate, the back plate is locally deformed and the deformation affects the wafer W, so that the adverse effect on the accuracy of polishing is concerned.

Therefore, a conventional wafer polishing apparatus has a constitution wherein, as shown in FIG. 4 for example, a back plate 4 is pressed through an air bag 1 in a head body 2 so that the wafer W is evenly pressed. In another conventional wafer polishing apparatus shown in FIG. 5, the air bag 1 directly presses the wafer W. These constitutions are effective for evenly pressing the wafer W.

In FIGS. 4 and 5, the wafer W is polished with a polishing pad 20 attached on the upper surface of a polishing table 12. The wafer W is held by a retainer ring 3 at the circumference thereof.

However, the constitutions shown in FIGS. 4 and 5 have a problem that the control of the pressure applied on the wafer W (pressure in the air bag 1) is difficult. That is, the polishing pressure (pressure applied on the wafer W) required by the CMP was conventionally 40 to 60 kPa. However, in recent years, lower polishing pressure setting (e.g., 10 to 20 kPa) has been demanded in order to minimize the unevenness of film thickness on the surface of the wafer.

Controllers of polishing pressure, electro-pneumatic regulators which especially being used often in the CMP polishing apparatus generally have a maximum pressure of 100 kPa or more, and when such controllers are used in a pressure range between 10 and 20 kPa, the accuracy of control may often lower. Therefore, there has been a problem that required polishing quality cannot be easily obtained.

Also in FIGS. 4 and 5, the retainer ring 3 is pressed against the polishing pad 20 through the head body 2; however, if the pressure applied on the retainer ring 3 is excessively high, the control of polishing the edge portion of the wafer W becomes unstable, and a problem that even polishing is interfered arises. It is therefore preferable that the pressure applied on the retainer ring 3 is appropriately controlled.

SUMMARY OF THE INVENTION

In such a situation, the object of the present invention is to provide a wafer polishing apparatus that can maintain the quality of wafers by enabling the control of appropriate polishing pressure and the like.

In order to achieve the above-described object, the present invention is directed to a wafer polishing apparatus for polishing a wafer, comprising: a polishing pad; and a holding head which holds the wafer and presses the wafer against the polishing pad, wherein the holding head comprises: a carrier which presses the wafer against the polishing pad; a retainer ring arranged at a circumference of the carrier; and a holding head body including a carrier pressing device through which a pressing force is transmitted to the carrier, the carrier pressing device having an air bag of which pressing surface area is 50% or smaller of an area of the wafer.

According to the present invention, the quality of wafers can be maintained high by enabling the control of the appropriate polishing pressure.

In the present invention, it is preferable that the holding head body further includes a retainer ring pressing device through which a pressing force is transmitted to the retainer ring, the retainer ring pressing device having an air bag of which pressing surface area is 50% or smaller of an area of a bottom surface of the retainer ring.

According to the present invention, the accuracy of controlling the pressure applied on the retainer ring can be improved. Thereby, the accuracy of controlling pressing force, especially the accuracy at the wafer edge portions can be improved, and the quality of wafers can be maintained high.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The preferred embodiment of a wafer polishing apparatus according to the present invention will be described in detail below referring to the attached drawings.

Figure 1:
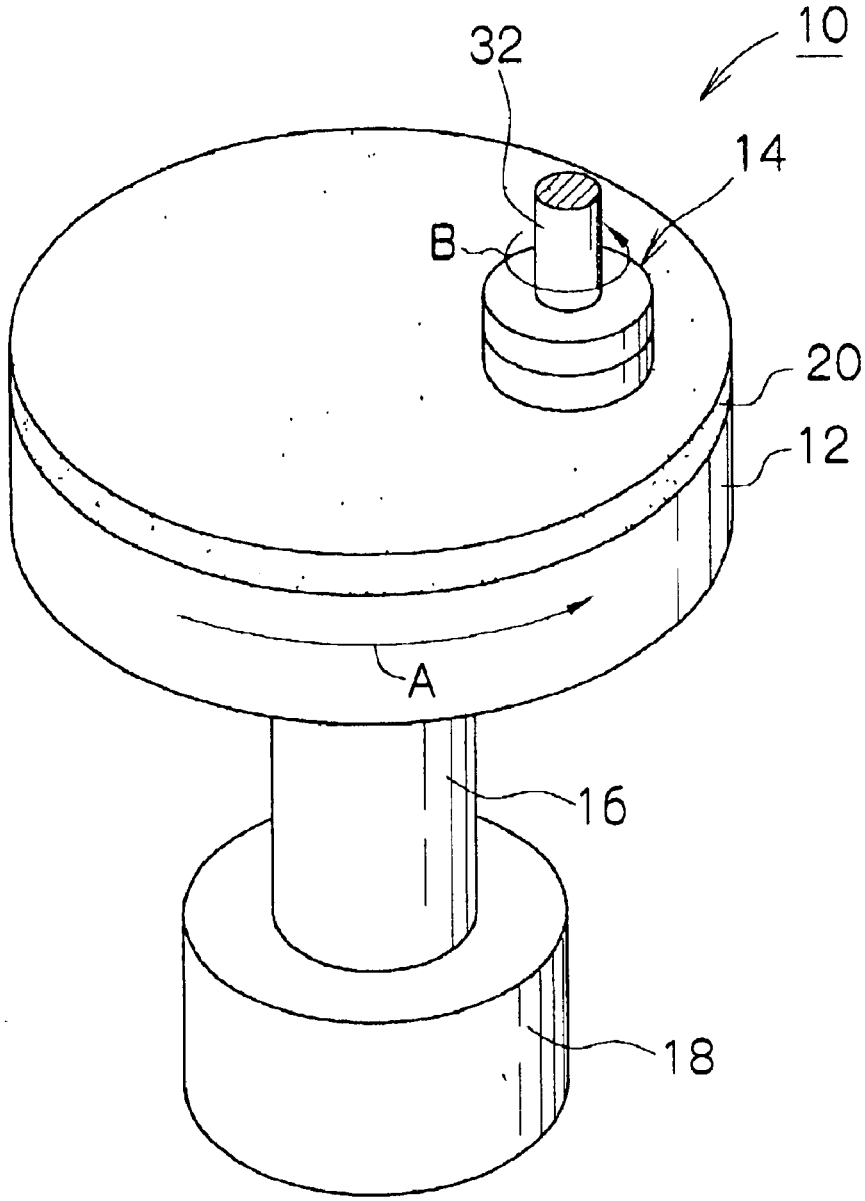
FIG. 1 is a perspective view showing the whole constitution of a wafer polishing apparatus.

FIG. 1 is a perspective view showing the whole constitution of a wafer polishing apparatus 10. As shown in FIG. 1, the wafer polishing apparatus 10 is mainly composed of a polishing table 12 and a wafer holding head 14.

The polishing table 12 is formed in a disk shape, and a rotating shaft 16 is connected to the center of the bottom surface thereof. The polishing table 12 is rotated when a motor 18 connected to the rotating shaft 16 is operated. A polishing pad 20 is attached on the upper surface of the polishing table 12, and a mechanochemical abrasive (slurry) is supplied from a nozzle (not shown) onto the polishing pad 20.

Figure 2:
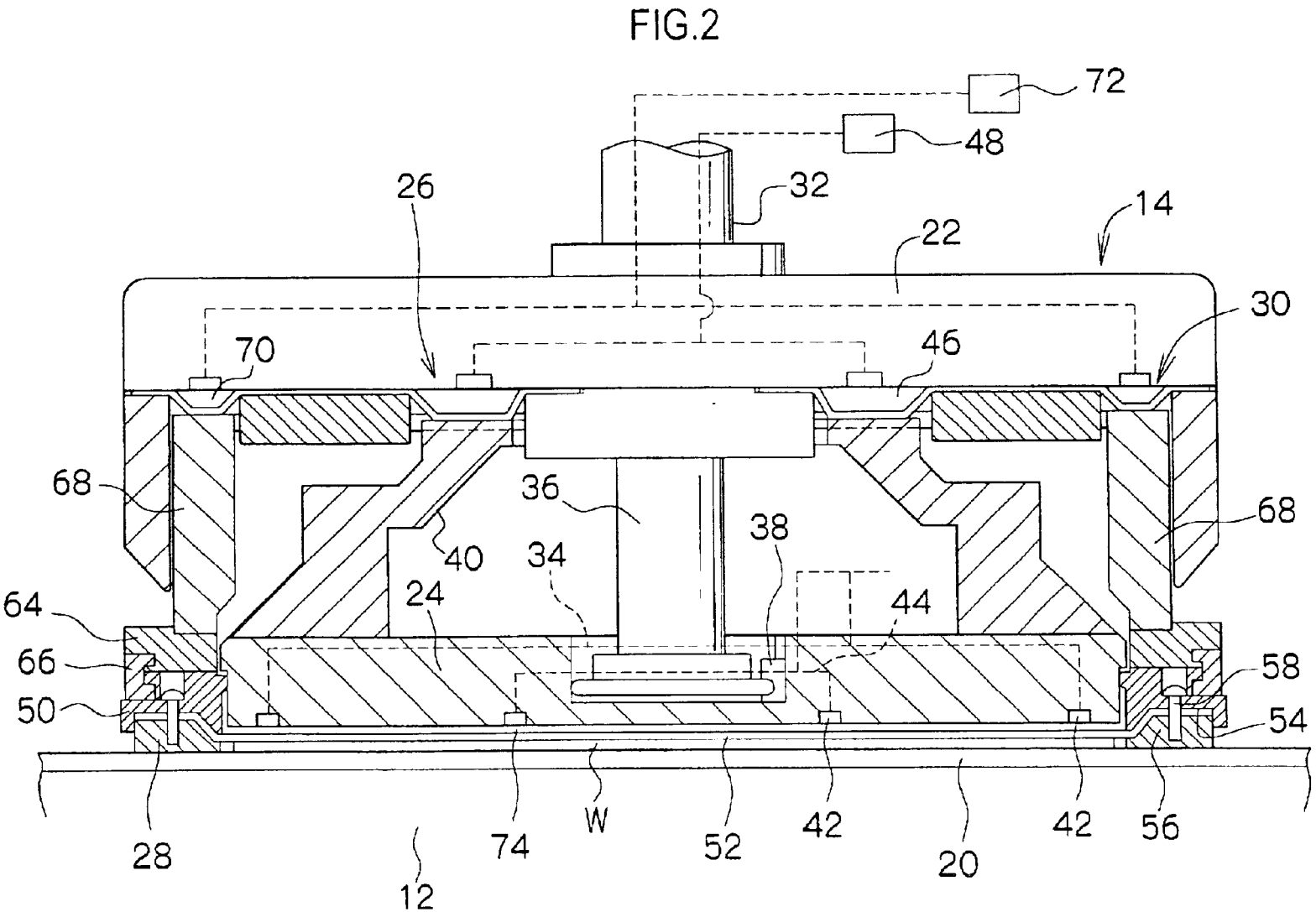
FIG. 2 is a vertically sectional view showing the constitution of a holding head.

As shown in FIG. 2, the wafer holding head 14 is mainly composed of a holding head body 22, a carrier 24, a carrier pressing device 26, a retainer ring 28, a retainer ring pressing device 30, a protective sheet 52 and an air controller.

The holding head body 22 is formed in a disk shape, and a rotating shaft 32 is connected to the center of the upper surface thereof. The holding head body 22 is rotated when a motor (not shown) connected to the rotating shaft 32 is operated.

The carrier 24 is formed in a disk shape, and disposed on the center of the lower portion of the holding head body 22. A cylindrical recess 34 is formed on the center of the upper surface of the carrier 24. A shaft portion 36 of the holding head body 22 is fitted to the recess 34 through a pin 38. Rotation is transmitted from the holding head body 22 to the carrier 24 through the pin 38.

A carrier pressing member 40 is provided on the circumference of the upper surface of the carrier 24. The pressing force from the carrier pressing device 26 is transmitted to the carrier 24 through the carrier pressing member 40.

On the bottom surface of the carrier 24 are formed air suction/blowout grooves 42, which are air supply paths for injecting the air to the protective sheet. An air duct 44 formed in the carrier 24 is communicated to the air suction/blowout grooves 42. To the air duct 44 are connected a suction pump and an air supply pump through air pipes (not shown). The suction and blowout of the air in and from the air suction/blowout grooves 42 are performed by switching these suction pump and air supply pump.

The air controller is mainly composed of the above-described air suction/blowout grooves 42, air duct 44, air pipes, suction pump, air supply pump, and the device for switching these suction pump and air supply pump.

The carrier pressing device 26 is disposed on the circumference of the center portion of the bottom surface of the holding head body 22, and applies a pressing force to the carrier pressing member 40, so as to transmit the pressing force to the carrier 24. The carrier pressing device 26 is preferably composed of an air bag 46 made of a rubber sheet that is expanded and contracted by intake and exhaustion of the air. An air supply mechanism 48 is connected to the air bag 46 for supplying the air, and the air supply mechanism 48 is equipped with a regulator (not shown) for controlling the pressure of the air compressed and supplied by a pump (not shown).

The pressing surface area of the air bag 46 is required to be 50% or less of the area of the wafer W. By thus designing the pressing surface area of the air bag 46, the pressure controlled by the regulator for controlling the pressure of the air supplied to the air bag 46 can be twice or more the polishing pressure (the pressure applied on the wafer W).

As a result, the electro-pneumatic regulator having a maximum pressure of about 100 kPa, which is often used in CMP polishing apparatuses, can be used within a proper range; that is, a pressure range of a high control accuracy. Thus, the control of the polishing pressure becomes more accurate, contributing to the improvement of the quality of the wafer W.

It is more preferable that the pressing surface area of the air bag 46 is 30% or less of the area of the wafer W. By thus designing the pressing surface area of the air bag 46, the pressure controlled by the regulator for controlling the pressure of the air supplied to the air bag 46 can be about 3.3 times or more the polishing pressure (the pressure applied on the wafer W).

The material of the air bag 46 is preferably a rubber such as a chloroprene rubber, and other materials such as flexible resin materials can be used.

The retainer ring 28 is formed in a ring form, and disposed on the circumference of the carrier 24. The retainer ring 28 is mounted on a holder (retainer ring holder) 50 provided on the wafer holding head 14, and a protective sheet 52 is spread on the inside of the retainer ring 28.

Figure 3:
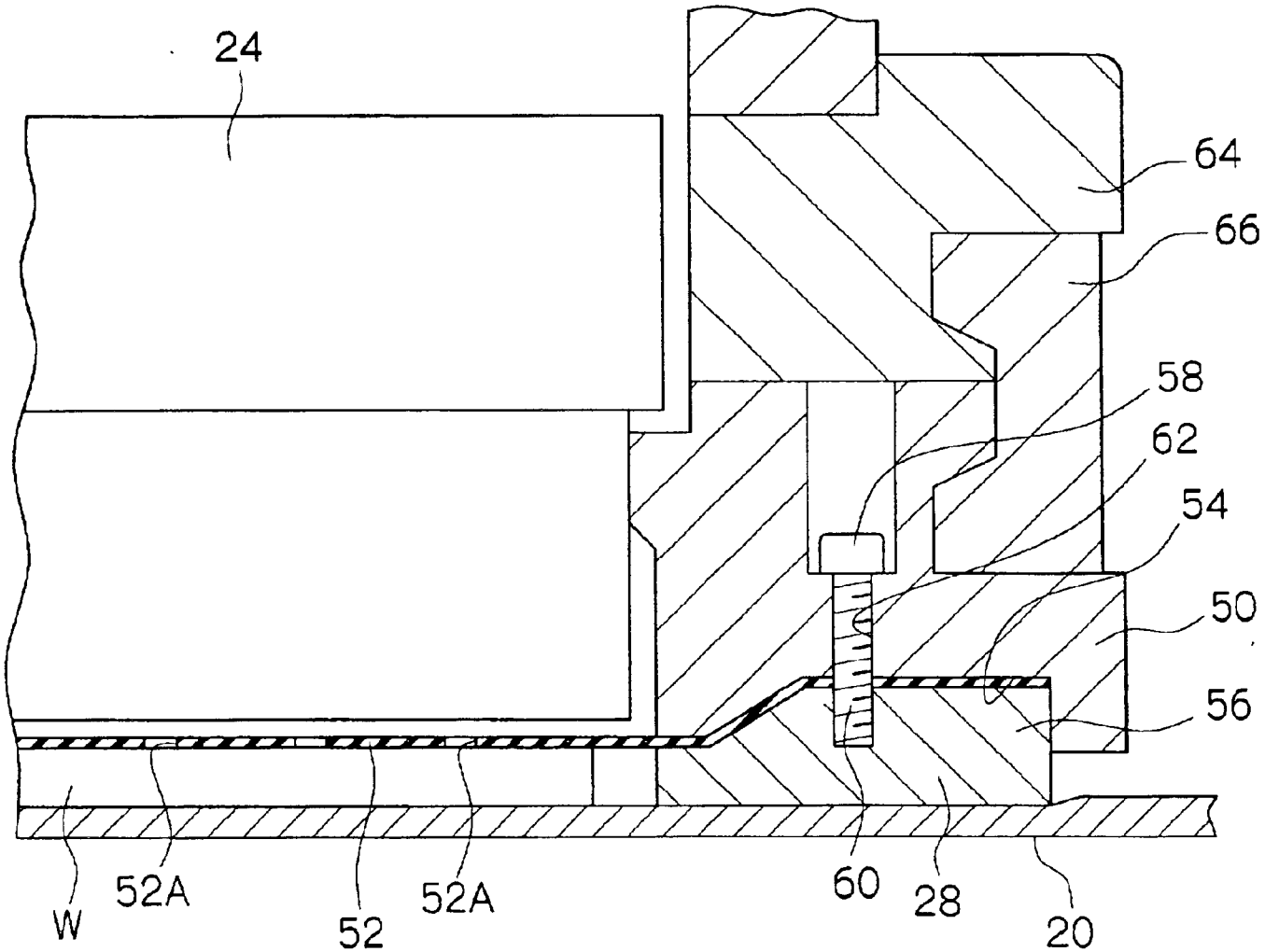
FIG. 3 is a sectional view showing the constitution of the sandwiching portion of a protecting sheet.
Figure 4:
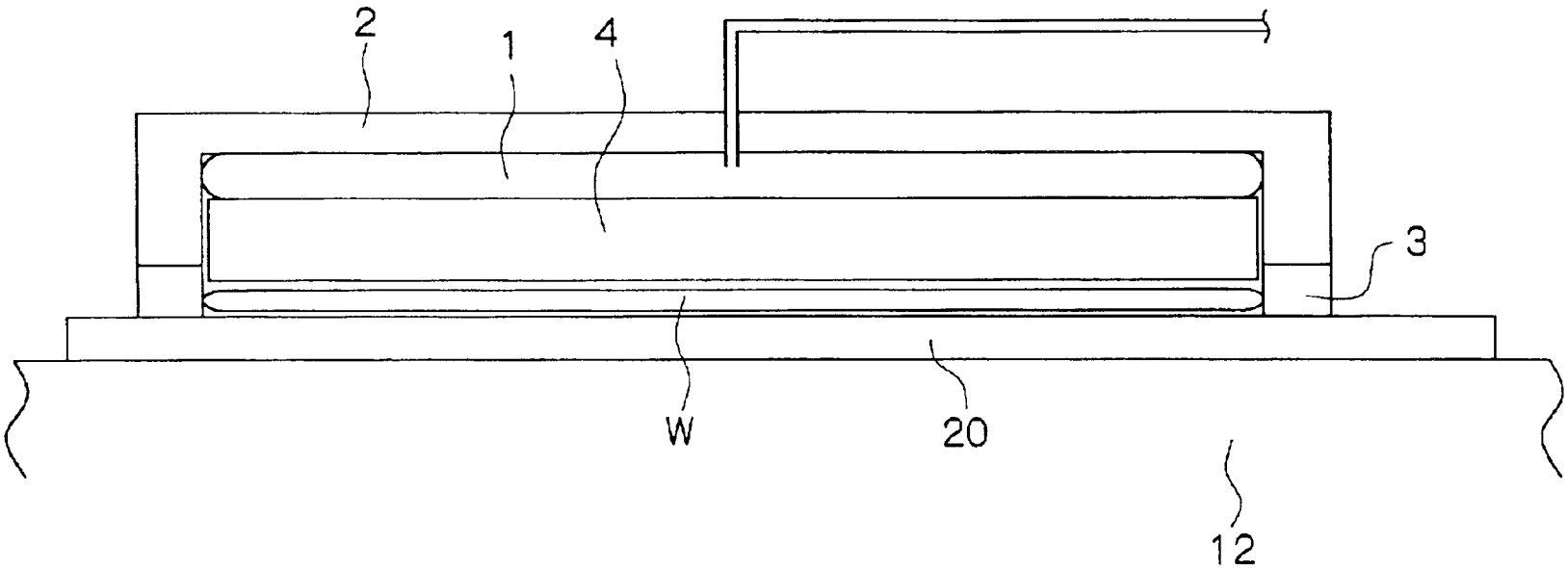
FIG.4 PRIOR ART
FIG. 4 is a sectional view showing the constitution of the main part of a conventional holding head.
Figure 5:
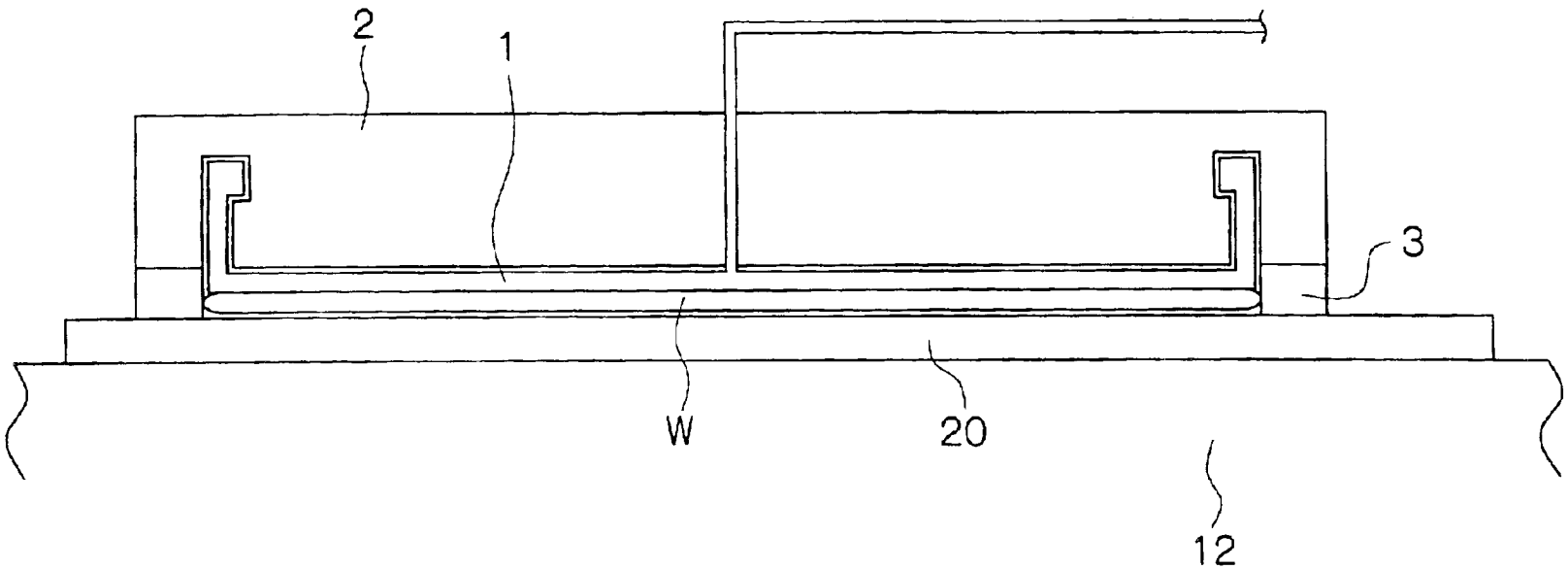
FIG.5 PRIOR ART
FIG. 5 is a sectional view showing the constitution of the main part of another conventional holding head.

The retainer ring holder 50 is formed in a ring form, and an annular recess 54 is formed on the bottom surface thereof as shown in FIGS. 2 and 3. On the other hand, a protruding portion 56 that fits to the recess 54 is formed on the upper surface of the retainer ring 28, and the retainer ring 28 is fitted to the retainer ring holder 50 by fitting the protruding portion 56 to the recess 54 of the retainer ring holder 50.

The protective sheet 52 is formed in a circular shape, and has a plurality of holes 52A. The circumference of the protective sheet 52 is sandwiched between the retainer ring 28 and the retainer ring holder 50 so that the protective sheet 52 is spread on the inside of the retainer ring 28.

The protective sheet 52 must be made of a material that is flexible enough to transmit air kinetic pressure in the air layer produced by the suction/blowout groove 42 of the carrier 24 to the wafer W, and that does not contaminate the wafer W.

The retainer ring 28 is fixed to the retainer ring holder 50 by fitting the protruding portion 56 thereof to the recess 54 of the retainer ring holder 50, and then fastening with bolts 58, 58 . . . . For receiving the bolts 58, threaded holes 60, 60 . . . are formed in a constant distance in the retainer ring 28, and through-holes 62, 62 . . . are formed in a constant distance in the retainer ring holder 50.

As shown in FIG. 2, under the carrier 24 where the protective sheet 52 is spread, an air layer 74 is formed between the carrier 24 and the protective sheet 52. The wafer W is pressed by the carrier 24 through the air layer 74. The internal pressure of the air layer 74 is elevated by blowing the air out of the suction/blowout grooves 42 of the carrier 24. The holes 52A formed in the protective sheet 52 act as holes for sucking when the wafer W is held and conveyed. During polishing, since the air passes through the holes 52A, the protective sheet 52 is only present in the air layer 74, and does not act to the back of the wafer W.

The retainer ring holder 50 is mounted to a mounting member 64 formed in a ring shape through a snap ring 66. To the mounting member 64 is connected the retainer ring pressing member 68 shown in FIG. 2. To the retainer ring 28, a pressing force is transmitted from the retainer ring pressing device 30 through the retainer ring pressing member 68.

The retainer ring pressing device 30 is disposed on the circumference of the bottom surface of the holding head body 22, and applies a pressing force to the retainer ring pressing member 68, so as to press the retainer ring 28 connected to the retainer ring pressing member 68 against the polishing pad 20. The retainer ring pressing device 30 is also preferably composed of an air bag 70 made of a rubber sheet as in the carrier pressing device 26. An air supply mechanism 72 is connected to the air bag 70 for supplying the air, and the air supply mechanism 72 is equipped with a regulator (not shown) for controlling the pressure of the air compressed and supplied by a pump (not shown).

The pressing surface area of the air bag 70 is preferably 50% or less of the area of the bottom surface of the retainer ring 28. By thus designing the pressing surface area of the air bag 70, the pressure controlled by the regulator for controlling the pressure of the air supplied to the air bag 70 can be twice or more the pressure applied on the bottom surface of the retainer ring 28.

As a result, an electro-pneumatic regulator having a maximum pressure of about 100 kPa, which is often used in CMP polishing apparatuses, can be used within a proper range; that is, a pressure range of a high control accuracy. Thus, the control of the pressure applied on the retainer ring 28 becomes more accurate. Especially, the accuracy of controlling the pressure at the wafer edge portions can be improved, and the quality of wafers can be maintained high.

It is more preferable that the pressing surface area of the air bag 70 is 30% or less of the area of the bottom surface of the retainer ring 28. By thus designing the pressing surface area of the air bag 70, the pressure controlled by the regulator for controlling the pressure of the air supplied to the air bag 70 can be about 3.3 times or more the pressure applied on the bottom surface of the retainer ring 28.

The material of the air bag 70 is preferably a rubber such as a chloroprene rubber, and other materials such as flexible resin materials can be used.

The method for polishing a wafer using the wafer polishing apparatus 10 constituted as described above will be described below.

First, a wafer W is held by the wafer holding head 14, and placed on the polishing pad 20. At this time, the wafer W is sucked and held using the suction/blowout groove 42 formed on the bottom surface of the carrier 24. For sucking the wafer W, the plurality of holes 52A are formed on the protective sheet 52 (see FIG. 3). Through the holes 52A, the wafer W is sucked and held.

Next, the air is supplied from the pump (not shown) to the air bags 46 and 70. At the same time, the air is supplied through the suction/blowout groove 42 of the carrier 24 to the air layer 74. Thereby, the internal pressure of the air layer 74 is elevated. Next, the air bags 46 and 70 expand, and press the wafer W and the retainer ring 28 against the polishing pad 20 at predetermined pressures, respectively. In this state, the polishing table 12 is rotated in the direction of A shown in FIG. 1, and at the same time, the wafer holding head 14 is rotated in the direction of B shown in FIG. 1. Then, the slurry is supplied from the nozzle (not shown) onto the rotating polishing pad 20. Thus, the bottom surface of the wafer W is polished by the polishing pad 20.

The constitution described above is the embodiment of the present invention, and the constitution of the present invention is not limited thereto, but various constitutions can be adopted.

For example, although the above-described embodiment uses the protective sheet 52, a constitution not using the protective sheet 52 can also be adopted. In that case, the carrier 24 directly presses the wafer W, or the constitution is based on the so-called static pressure bearing principle, wherein the wafer W is pressed through the air injected from the suction/blowout groove 42.

According to the present invention, as described above, the polishing pressure can be properly controlled by providing the carrier pressing device having the air bag the area of which pressing surface is 50% or less of the area of the wafer. Thereby, the quality of wafers can be maintained high.

The pressing force of the retainer ring can also be properly controlled by providing the retainer ring pressing device having the air bag the area of which pressing surface is 50% or less of the area of the bottom surface of the retainer ring. Thereby, the accuracy of controlling the pressure applied on the retainer ring, especially at the wafer edge portions can be improved, and the quality of wafers can be maintained high.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus for polishing a wafer, comprising:

a polishing pad; and a rotatable holding head which holds the wafer and presses the wafer against the polishing pad, wherein the holding head comprises:

a carrier which presses the wafer against the polishing pad through a pressurized air layer;

a retainer ring arranged at a circumference of the carrier;

a holding head body including a carrier pressing device through which a pressing force is transmitted to the carrier, and a shaft extending from the holding head body and the carrier, wherein the carrier pressing device includes an air bag of a flexible sheet material in which a pressing surface area of the air bag is 50% or smaller of an area of the wafers, wherein the carrier includes a central recess into which a shaft end is positioned, and wherein the central recess includes a locking pin extending radially inward from a circumferential wall of the recess into engagement with the end of the shaft to enable rotation of the carrier.

2. The wafer polishing apparatus according to claim 1, wherein the holding head body further includes a retainer ring pressing device through which a pressing force is transmitted to the retainer ring, the retainer ring pressing device having another air bag of a flexible sheet material in which a pressing surface area of said another air bag is 50% or smaller of the retainer ring.

* * * * *